US005340606A

United States Patent [19]

Sano et al.

[11] Patent Number: 5,340,606

[45] Date of Patent: Aug. 23, 1994

[54] OPTICAL READING METHOD

[75] Inventors: Shojiro Sano; Ken Iwakura, both of Shizuoka, Japan

[73] Assignee: Fuji Photo Film Co., Ltd., Kanagawa, Japan

[21] Appl. No.: 918,607

[22] Filed: Jul. 27, 1992

[30] Foreign Application Priority Data

Jul. 26, 1991 [JP] Japan ..... 3-208898

[51] Int. Cl.[5] ..... B41M 3/12

[52] U.S. Cl. ..... 427/151; 427/152; 427/209

[58] Field of Search ..... 427/151, 209, 152

[56] References Cited

U.S. PATENT DOCUMENTS

| | | | |
|---|---|---|---|
| 4,820,550 | 4/1989 | Naoki et al. | 427/151 |
| 4,822,768 | 4/1989 | Ohga et al. | 427/151 |
| 4,835,133 | 5/1989 | Yanagihara et al. | 427/151 |
| 4,849,397 | 7/1989 | Sano et al. | 427/151 |
| 4,855,282 | 8/1989 | Satomura et al. | 427/15 |

FOREIGN PATENT DOCUMENTS 61-87758 5/1986 Japan .

*Primary Examiner*—Janyce Bell
*Attorney, Agent, or Firm*—Sughrue, Mion, Zinn, Macpeak & Seas

[57] ABSTRACT

A method of optically reading colored record images formed by the reaction of a substantially colorless electron donating dye and an electron accepting developer in a pressure-sensitive recording sheet with a red light having a wavelength of from 620 nm to 700 nm, wherein the pressure-sensitive recording sheet comprises an electron accepting developer layer containing a metal salt of an aromatic carboxylic acid as the electron accepting developer and an electron donating dye layer containing a phthalide compound represented by the following formula (1) as the electron donating dye:

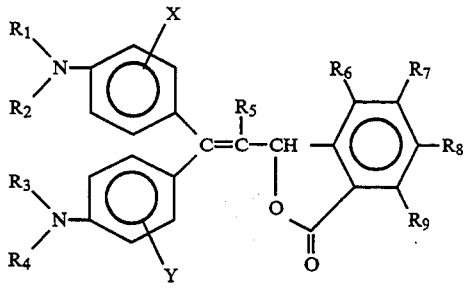

(1)

wherein $R_1$, $R_2$, $R_3$, and $R_4$ each represents a substituted or unsubstituted alkyl group, a substituted or unsubstituted aralkyl group, or a substituted or unsubstituted aryl group; the $R_1$ and $R_2$ or the $R_3$ and $R_4$ may combine with each other to form a ring; $R_5$ represents a hydrogen atom or an alkyl group; R6, $R_7$, $R_8$, and $R_9$ each represents a hydrogen atom, a halogen atom, an alkyl group, an alkoxy group, a substituted amino group, or an alicyclic amino group; and X and Y each represents a hydrogen atom, an alkyl group, or an alkoxy group.

7 Claims, No Drawings

OPTICAL READING METHOD

FIELD OF THE INVENTION

The present invention relates to an optical reading method of colored record images formed in a pressure-sensitive recording sheet, and more particularly to a method of optically reading colored record images formed in a pressure-sensitive recording sheet by scanning with red light having a wavelength of from 620 nm to 700 nm.

BACKGROUND OF THE INVENTION

Recently, optical reading such as bar-code reading, and the like, conducting scanning with a red LED (light emitting diode) or a laser light having a wavelength of from 620 nm to 700 nm has been practiced. Conventional bar codes typically have been formed by printing, heat-sensitive recording, and the like. However, more recently, pressure-sensitive recording sheets using microcapsules have been proposed which can carry out the above bar-code reading of an assembly constituted by a stack of two to six colored copy sheets.

In order to carry out optical reading with red light in a range of from 620 nm to 700 nm in wavelength, as described above, it is necessary that the colored dye used on the pressure-sensitive recording sheet has a strong absorption in the above-indicated red wavelength region. As compounds for forming dyes meeting this purpose, for example, the phthalide compounds described in JP-A-61-87758 (the term "JP-A" as used herein means an "unexamined published Japanese patent application") can be used.

The present inventors have investigated pressure-sensitive recording sheets using the phthalide compounds as described in JP-A-61-87758 and found that the following problems exist. For instance, when clays such as acid clay, active clay, etc., phenol resins, organic acids, etc., as described in JP-A-61-87758 are used as a developer, the color density obtained was insufficient, the dyes formed had inferior light fastness, the dyes decomposed, especially in sunlight, and did not show the desired absorption.

SUMMARY OF THE INVENTION

As the result of various investigations for solving the foregoing problems, the present inventors have succeeded in obtaining a pressure-sensitive recording sheet and assemblies thereof suitable for forming colored record images which are capable of being optically read by scanning with a red light of the wavelength region of from 620 nm to 700 nm, the colored images having excellent light fastness, among other things.

That is, according to the present invention, there is provided a method of optically reading colored record images formed by the reaction of a substantially colorless electron donating dye and an electron accepting developer in a pressure-sensitive recording sheet by a red optical reading apparatus of a wavelength of from 620 nm to 700 nm, wherein the pressure-sensitive recording sheet comprises the electron accepting developer layer which contains a metal salt of an aromatic carboxylic acid as the developer and an electron donating dye layer which contains a phthalide compound represented by the following formula (1) as the electron donating dye:

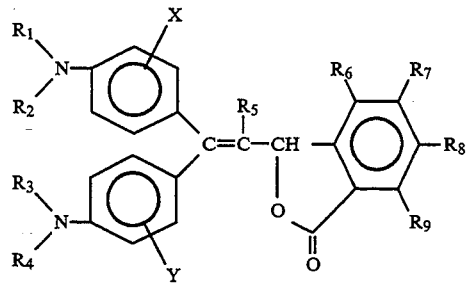

(1)

wherein $R_1$, $R_2$, $R_3$, and $R_4$ each represents a substituted or unsubstituted alkyl group, a substituted or unsubstituted aralkyl group, or a substituted or unsubstituted aryl group (preferably an alkyl group having 1 to 4 carbon atoms which may have a substituent); the $R_1$ and $R_2$ or the $R_3$ and $R_4$ may combine with each other to form a ring; $R_5$ represents a hydrogen atom or an alkyl group (preferably a hydrogen atom); $R_6$, $R_7$, $R_8$, and $R_9$ each represents a hydrogen atom, a halogen atom, an alkyl group, an alkoxy group, a substituted amino group, or an alicyclic amino group (each of $R_6$, $R_7$, and $R_9$ is preferably a hydrogen atom and $_5$ is preferably a dimethyl amino group or a diethyl amino group); and X and Y each represents a hydrogen atom, an alkyl group, or an alkoxy group (preferably a hydrogen atom).

The pressure sensitive sheet of the present invention preferably arranges the election donating dye in a coating layer on one surface of a base paper and the developer in a separate coating layer on the opposite side of the base paper. By stacking the thus obtained sheets such that the electron donating dye layer(s) contact the developer layer(s) of an adjacent sheet(s), pressure recording can be practiced.

Also, in the present invention, the electron donating dye layer can further contain a fluorane derivative having an anilino group at the 2-position and a substituted amino group at the 6-position as a black coloring dye to be used together with the foregoing phthalide compound for facilitating scanning recognition of the colored images.

In another embodiment of the present invention, the pressure sensitive sheet comprises a base sheet having the electron donating dye containing layer and the developer containing layer sequentially coated, in no particular order, on a common side of the base sheet.

DETAILED DESCRIPTION OF THE INVENTION

Preferred useful examples of the metal salt of an aromatic carboxylic acid that can be used as a developer for the electron accepting developer layer in this invention, include the zinc salts, nickel salts, aluminum salts, calcium salts, and the like, of 3,5-di-t-butylsalicylic acid, 3,5-di-t-octylsalicylic acid, 3,5-di-t-nonylsalicylic acid, 3,5-di-t-dodecylsalicylic acid, 3-methyl-5-t-dodecylsalicylic acid, 3-t-dodecylsalicytic acid, 5-t-dodecylsalicylic acid, 5-cyclohexylsalicylic acid, 3,5-bis(α-methylbenzyl)salicylic acid, 3,5-bis(α,α-dimethylbenzyl)salicylic acid, 3-methyl-5-(α-methylbenzyl)salicylic acid, 3-(α,α-dimethylbenzyl)-5-methylsalicylic acid, 3-(α,α-dimethylbenzyl)-6-methylsalicylic acid, 3-(α-methylbenzyl)-5-(α,α-dimethylbenzyl)salicylic acid, 3-(α,α-dimethylbenzyl)-6-ethylsalicylic acid, 3-phenyl-5-(α,α-dimethylbenzyl)salicylic acid, a carboxy modified terpenephenol resin, a salicylic acid resin which is the reaction product of 3,5-bis(α-methylbenzyl)salicylic acid and benzyl chloride, preferably zinc salts of a substituted salicylic acid. The type of metal cation selected for use in combination with the aromatic carboxylic acid is not particularly limited.

The metal salt of the aromatic carboxylic acid for use in the present invention can be mechanically dispersed in an aqueous system or dissolved in an organic solvent.

In the case of mechanically dispersing the metal salt in an aqueous system, the mixture is treated with a ball mill, an attritor, a sand grinder, etc., and is used as a dispersion.

As the organic solvent for dissolving the metal salt of the aromatic carboxylic acid, examples are diisopropyl naphthalene, 1-phenyl-l-xylylethane, 1-phenyl-1-isopropylphenylethane, 1-phenyl-l-ethylphenylethane, toluene, xylene, methyl ethyl ketone, methyl isobutyl ketone, diisobutyl ketone, ethyl acetate, butyl acetate, amyl acetate, methylene chloride, butanol, paraffin, kerosene, and the like.

The metal salt of the aromatic carboxylic acid is dissolved in the foregoing organic solvent in an amount of from 10 to 200% by weight.

The foregoing organic solvent solution is then dispersed by emulsification in water containing a dispersing agent in an amount of from 5 to 120% by weight, and preferably from 50 to 100% by weight. Subsequently, the organic solvent may be removed by heating the emulsified dispersion.

As the dispersing agent, ionic or nonionic surface active agents or water-soluble poisoners can be used.

As the surface active agent, examples are alkylbenzenesulfonates, alkylnaphthalenesulfonates, alkylsulfonates, dialkylsulfosuccinates, polyoxyethylene alkyl ethers, polyoxyethylene alkylphenyl ethers, polyhydric alcohol fatty acid partial esters, and the like. Also, as the water-soluble polymer, examples are polyvinyl alcohol, denatured polyvinyl alcohol, polyacrylamide, sodium polyacrylate, polyvinyl ether, sodium polystyrenesulfonate, a maleic anhydride copolymer, and the like.

As the binder material for the developer layer, examples are latexes such as styrene-butadiene copolymer latexes, vinyl acetate series latexes, acrylic acid ester series latexes, and the like, and synthetic or natural high-molecular materials such as polyvinyl alcohol, polyacrylic acid, a maleic anhydride-styrene copolymer, starch, casein, gum arabic, gelatin, carboxymethyl cellulose, methyl cellulose, and the like.

The final amount of the developer (metal salt of an aromatic carboxylic acid) coated on a support or base paper is from 0.1 g/m$^2$ to 3.0 g/m$^2$, and preferably from 0.2 g/m$^2$ to 1.0 g/m$^2$.

The color former (electron donating dye) for use in the present invention is the phthalide compound shown by formula (1) described above.

In formula (1), $R_1$ and $R_2$ or $R_3$ and $R_4$ may combine with each other to foden a ring as described above and examples of such a ring are a pyrrolidino group, and the like.

Specific examples of the phthalide compound shown by formula (1) described above are illustrated in Table A below.

TABLE A $R_5=R_6=R_9=H$

| No. | $R_1$ | $R_2$ | $R_3$ | $R_4$ | X | Y | $R_7$ | $R_8$ |
|---|---|---|---|---|---|---|---|---|
| 1 | $Me_2N$ | | $Me_2N$ | | H | H | H | $Me_2N$ |
| 2 | $Et_2N$ | | $Et_2N$ | | H | H | H | $Me_2N$ |
| 3 | $Bu_2N$ | | $Bu_2N$ | | H | H | H | $Me_2N$ |
| 4 | $Me_2N$ | | $Me_2N$ | | H | H | H | $Et_2N$ |
| 5 | $Et_2N$ | | $Et_2N$ | | H | H | H | $Et_2N$ |
| 6 | | N | | N | H | H | H | $Me_2N$ |
| 7 | $Et_2N$ | | $Et_2N$ | | H | H | H | H |
| 8 | $Et_2N$ | | $Et_2N$ | | H | H | H | Cl |
| 9 | $Et_2N$ | | $Et_2N$ | | H | H | $CH_3O$ | H |
| 10 | $Me_2N$ | | $Me_2N$ | | Me | Me | H | $Me_2N$ |
| 11 | $Me_2N$ | | $Me_2N$ | | MeO | MeO | H | $Me_2N$ |
| 12 | Et | N, Me | Et | N, Me | H | H | H | $Me_2N$ |

The amount of the color former coated on a support or base paper is preferably from 0.02 g/m$^2$ to 0.10 g/m$^2$.

Also, in the present invention, it is preferred to use a fluoran derivative having an anilino group at the 2-position and a substituted amino group at the 6-position together with the foregoing phthalide compound for facilitating scanning recognition of the colored record images as described above.

Preferred examples of the fluoran derivative for use in this invention are those shown by the following formula.

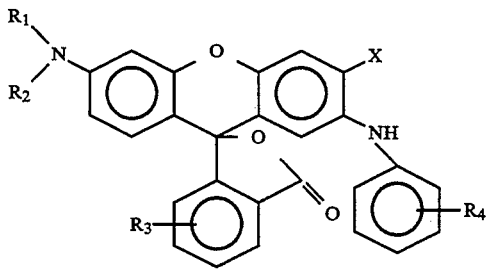

wherein $R_1$, $R_2$, and $R_3$ each represents an alkyl group having from 1 to 10 carbon atoms; $R_4$ represents a hydrogen atom or an alkyl group having from 1 to 8 carbon atoms; and X represents an alkyl group having from 1 to 8 carbon atoms or a chloride atom.

In the above formula, the alkyl groups shown by $R_1$ and $R_2$may combine with each other to form a ring, and, further, each of $R^1$ and $R^2$ may have a substituent.

In the compounds shown by the above fluoran formula, the compound wherein X is a methyl group or a chlorine atom is particularly preferable.

Specific examples of colorless or faint color fluoran derivatives (electron donating dye precursor) for use in this invention are shown below, although the invention is not limited to them.

That is, examples are 2-anilino-3-methyl-6-dimethylaminofluoran, 2-anilino-3-methyl-6-N-methyl-N-ethylaminofluoran, 2-anilino-3-methyl-6-N-methyl-N-(isopropyl)aminofluoran, 2-anilino-3-methyl-6-N-methyl-N-pentylaminofluoran, 2-anilino-3-methyl-6-N-methyl-N-cyclohexylaminofluoran, 2-anilino-3-methyl-6-diethyl aminofluoran, 2-anilino-3-chloro-6-dimethylaminofluoran, 2-anilino-3-methyl-6-N-ethyl-N-isoamylaminofluoran, 2-anilino-3-methyl-6-N-methyl-N-isoamylaminofluoran, 2-anilino-3-chloro-6-diethylaminofluoran, 2-anilino-3-chloro-6-N-methyl-N-ethylaminofluoran, 2-anilino-3-chloro-6-N-methyl-N-(isopropyl)aminofluoran, 2-anilino-3-chloro-6-N-3-methyl-6-dimethylaminofluoran, 2- (p-methylanilino)-3-methyl-6-diethylaminofluoran, 2-(p-methylanilino ) -3-methyl-6-N-methyl-N-ethylamino fluoran, 2-(p-methylanilino)-3-methyl-6-N-methyl-N-(isopropyl-)aminofluoran, 2-(p-methylanilino)-3-methyl-6-N-methyl-Npentylaminofluoran, 2-(p-methylanilino)-3-methyl-6-N-methyl-N-cyclohexylaminofluoran, 2-(p-methylanilino)-3-methyl-6-N-ethyl-N-pentylaminofluoran,2-(p-methylanilino)-3-chloro-6-dimethylaminofluoran, 2-(p-methylanilino)-3-chloro-6-diethylaminofluoran, 2-(p-methylanilino)-3-chloro-6-N-methyl-N-ethylaminofluoran, 2-(p-methylanilino)-3-chloro-6-N-methyl-N-(isopropyl)aminofluoran, 2-(p-methylanilino)-3-chloro-6-N-methyl-N-cyclohexylaminofluoran, 2-(p-methylanilino)-3-chloro-6-N-methyl-N-pentylaminofluoran, 2-(p-methylanilino)-3-chloro-6-N-ethyl-N-pentylaminofluoran, 2-anilino-3-methyl-6-N-methyl-N-furylmethylaminofluoran, 2-anilino-3-ethyl-6-N-methyl-N-furylmethylaminofluoran, and the like.

The amount of the above fluoran derivative coated on a support or base paper is preferably from 0.02 g/m$^2$ to 0.10 g/m$^2$.

The color former (electron donating dye) for use in the present invention is dissolved in an organic solvent together with, if necessary, one of the foregoing fluoran derivatives, followed by microcapsulation, and coating on a support.

As the organic solvent for the coloring agent, natural or synthetic oils can be used singly or as a mixture thereof. Specific examples of the solvent are kerosene, paraffin, naphthene oil, alkylated biphenyls, alkylated terphenyls, chlorinated paraffin, alkylated naphthalene, diarylalkane, and phthalic acid esters.

As a method of producing the color former-containing microcapsules, conventional microencapsulation methods can be used, such as an interfacial polymerization method, an internal polymerization method, a phase separation method, an external polymerization method and coacervation method as described, for example, in U.S. Pat. No. 3,796,669 and 4,409,156.

At the time of the preparation of the coating liquid which contains the color former-containing microcapsules, a water-soluble binder or a latex-series binder is generally used in the present invention. Furthermore, a microcapsule protective agent such as cellulose powders, starch particles, talc, and the like, preferably is added thereto to provide the color former-containing microcapsule coating liquid to be coated on a support or base paper.

The pressure-sensitive recording sheet of the present invention is described by the following examples, but the invention is not limited thereto. Unless otherwise indicated, all parts, percents, ratios and the like are by weight.

EXAMPLES I-1

Preparation of color former-Containing Microcapsule Liquid

In 100 g of diisopropylnaphthalene were dissolved 6.0 g of compound No. 1 of formula (1) shown in Table A above as a color former and 4.0 g of 2-anilino-3-methyl-6-N-ethyl-N-pentylaminofluoran to provide an oily solution. Then, 10 g of carbodiimide-modified diphenylmethane diisocyanate (MDI-LK, trade name, made by Mitsui Toatsu Chemicals, Inc.), 5 g of the isocyanurate of hexamethylene diisocyanate (Colonate EH, trade name, made by Nippon Polyurethane K. K.), and 3.0 g of a butylene oxide addition product of ethylenediamine (the added mol number of butylene oxide to ethylenediamine: 16.8 mols, molecular weight: 1,267) were dissolved in the oily solution to provide a primary solution.

On the other hand, by dissolving 10 g of polyvinyl alcohol and 5 g of carboxymethyl cellulose in 140 g of water, a secondary solution was prepared.

Then, the foregoing primary solution was poured into the foregoing secondary solution with vigorous stirring to form an oil droplet-in-water type emulsion. When the size of the oil droplets became 6.0 μm, stirring was reduced. Then, after adding 10 g of water of 20° C. and 2.0 g of tetraethylenepentamine to the emulsion thus obtained, the temperature of the system was gradually raised to 80° C., and the system was kept at that temperature for 90 minutes.

To the microcapsule liquid thus obtained were added 80 g of an aqueous solution of 15% polyvinyl alcohol, 15 g of a carboxy-modified SBR latex as solid component, and 40 g of starch particles (mean particle size: 15 μm). Then, the solid component concentration thereof was adjusted to 20% by weight by the addition of water to provide a color former-containing microcapsule liquid.

Preparation of Developer Dispersion

In 80 g of xylene was dissolved 100 g of zinc 3,5-bis-(α-methylbenzyl)salicylate. The xylene solution was added to 120 g of an aqueous solution of 4% polyvinyl alcohol (PVA-205, trade name, made by Kuraray Co., Ltd.), and, after further adding thereto 4 g of an aqueous solution of 10% polyoxyethylene sorbitan oleate, the resultant mixture was emulsion-dispersed with a homogenizer such that the mean particle size of the emulsion became 1.0 μm to provide an emulsified dispersion.

Then, after adding 180 g of water to the emulsified dispersion and then heating the mixture, xylene and water were removed from the emulsified dispersion as an azeotropic mixture thereof to control the solid component concentration to 30% by weight, whereby a developer dispersion was obtained.

Preparation of Developer Coating Liquid

A mixture of 120 g of calcium carbonate, 20 g of zinc oxide, 1 g of sodium hexametaphosphate, and 200 g of water was subjected to a finely granulating treatment by means of a sand mill to provide an inorganic pigment dispersion.

To 300 g of the inorganic pigment dispersion were added 200 g of an aqueous solution of 9% pollrvinyl alcohol (PVA-117, trade name, made by Kuraray Co., Ltd.) and 4 g (as solid component) of carboxy-modified SBR latex (SN 307, trade name, made by Sumitomo Norgatac K. K.), and after further adding thereto 15 g of the foregoing developer dispersion, the solid component concentration of the mixture was adjusted to 20% by weight by the addition of water to provide a developer coating liquid.

Preparation of Intermediate Paper

The foregoing color former-containing microcapsule liquid was coated on one surface of a base paper having a basis weight rate of 40 g/m$^2$ at a solid component coverage rate of 4.0 g/m$^2$ by an air knife coater, and, the foregoing developer coating liquid was coated on the opposite surface of the base paper at a solid component coverage rate of 4.5 g/m$^2$ by an air knife coater followed by drying to provide an intermediate paper.

EXAMPLE I-2

By following the same procedure as Example I-1 except that 100 g of zinc 3-t-dodecylsalicylate was used in place of 100 g of zinc 3,5-bis(α-methylbenzyl)salicylate in the preparation of the developer dispersion in Example I-1, another intermediate paper was prepared.

EXAMPLE I-3

By following the same procedure as Example I-1 except that 100 g of zinc 3,5-di-t-butylsalicylate was used in place of 100 g of zinc 3,5-bis(α-methylbenzyl)-salicylate in the preparation of the developer dispersion in Example I-1, another intermediate paper was prepared.

COMPARATIVE EXAMPLE I

Preparation of Developer Coating Liquid

In 500 g of water were dispersed 200 g of active clay, 20 g of calcium carbonate, 8 g of magnesium oxide, 1 g of sodium hexametaphosphate, and 20 g of an aqueous 20% sodium hydroxide solution by a Kady mill. Then, by adding 40 g (as solid component) of a carboxy-modified SBR latex and 60 g of an aqueous 10% starch solution, a developer coating liquid was obtained.

Preparation of Intermediate Paper

The color former-containing microcapsule liquid was the same as used in Example I and was coated on one surface of a base paper having a basis weight of 40 g/m$^2$ at a solid component coverage rate of 4.0 g/m$^2$ by an air knife coater and the foregoing comparison developer coating liquid was coated on the opposite surface of the base paper at a solid component coverage rate of 6.0 g/m$^2$ by an air knife coater followed by drying to provide a comparison intermediate paper.

EXAMPLE II

Preparation of Color Former-Containing Microcapsule Liquid

In a mixture of 80 g of 1-phenyl-1-xylylethane and 20 g of isoparaffin were dissolved 6.0 g of compound No. 2 of formula (1) shown in Table A above as a coloring agent and 4.0 g of 2-anilino-3-methyl-6-dibutylamino-fluoran to provide an oily solution. Then, by dissolving 8 g of polymethylene polyphenyl polyisocyanate (Millionate MR200, trade name, made by Nippon Polyurethane K. K.) and 8 g of the biuret compound of hexamethylene diisocyanate (Sumidule N-3200, trade name, made by Sumitomo Bayer Urethane K. K.) in the foregoing oily solution, a primary solution was prepared.

On the other hand, by dissolving 10 g of polyvinyl alcohol and 5 g of carboxymethyl cellulose in 140 g of water, a secondary solution was prepared.

Then, the foregoing primary solution was poured into the foregoing secondary solution with vigorous stirring to provide an oil droplet-in-water type emulsion. When the mean particle size of the oil droplet became 8.0 μm, stirring was reduced. Then, after adding 10 g of water of 20° C. and 1.6 g of diethylenetriamine to the emulsion, the temperature of the system was gradually raised to 90° C., and the system was kept at that temperature for 60 minutes to provide a microcapsule liquid.

To the microcapsule liquid thus obtained were added 80 g of an aqueous solution of 15% polyvinyl alcohol, 15 g of a carboxy-modified SBR latex as solid component, and 30 g of starch particles (mean particle size: 15 μm) and then the solid component concentration thereof was adjusted to 20% by weight by the addition of water to provide a color former-containing microcapsule liquid.

Preparation of Intermediate Liquid

The foregoing color former-containing microcapsule liquid was coated on one surface of a base paper having a basic weight of 40 g/m$^2$ at a solid component coverage rate of 4.0 g/m$^2$ and the developer coating liquid as described in Example I-1 was coated on the opposite surface of the base paper at a solid component coverage rate of 4.5 g/m$^2$ each by an air knife coater followed by drying to provide an intermediate paper.

COMPARATIVE EXAMPLE II

The color former-containing microcapsule liquid as used in Example II was coated on one surface of a base paper having a basic weight of 40 g/m$^2$ at a solid component coverage rate of 4.0 g/m$^2$ and the developer coating liquid as used in Comparison Example I was coated on the other surface of the base paper at a solid component coverage rate of 6.0 g/m$^2$ each by an air knife coater followed by drying to provide a comparison intermediate paper.

EXAMPLE III

By following the same procedure as in Example I-1 except that 6.0 g of compound No. 10 of formula (1) shown in Table A above was used in place of compound No. 1 of formula (1) used in the preparation of the color former-containing microcapsule liquid in Example I-1, an intermediate paper was obtained.

Each of the intermediate papers obtained above was subjected to evaluation tests as a pressure-sensitive recording sheet and the results obtained are shown in Table B below. In addition, the evaluation tests were carried out by the following methods.

(1) Measurement of PCS (print contrast signal) Value

Each type of intermediate paper was superposed (stacked) on another identical type of intermediate paper such that the color former-containing microcapsule coated layer of the first paper faced and was in contact with the developer-coated layer of the second paper to form an assembly. A load of 300 kg/cm$^2$ was applied selectively to the assembly to cause selective coloring. After allowing the assembly to stand in the dark for 24 hours, the papers were separated and the reflectance of the revealed developer-coated surface was measured at from 380 nm to 1,000 nm by a spectrophotometer (UV-3100, trade name, manufactured by Shimazu Corporation). The PCS value was calculated by the following formula.

$$\text{PCS value} = (A - B)/A$$

A: Reflectance of the background portion.

B: Reflectance of the colored portion.

(2) Light Fastness Test of colored Portion

After irradiating the colored portion formed in above method ( 1 ) by a fluorescent lamp fade-o-meter ( 33,000 lux ) for 16 hours , the PCS value thereof was measured by the same manner as in above (1).

(3) Bar Code Reading Test (a) Bar Code Printing

Five intermediate papers of the same kind were superposed and a bar code of NW-7 was printed thereon with a dot impact printer (8340 SV, trade name, manufactured by Oki Electric Industry Co., Ltd.).

(b) Bar Code Reading

After allowing the assembly to stand in the dark for 24 hours , the 5th printed sample ( the lowermost intermediate paper) was separated from the assembly and subjected to a reading test of the bar code formed on this 5th printed sample with a bar code reader (BHT-20561, trade name, manufactured by NIPPONDENSO Co., Ltd.). As an additional test, after irradiating this 5th printed sample with a fluorescent lamp fade-o-meter (33,000 lux) for 16 hours, the reading test of the bar code was then repeated by the same manner as above.

The results obtained are shown in Table B below.

TABLE B

| Example No. | Before Irradiation by Fluorescent Lamp: PCS Value (660 nm) | Before Irradiation by Fluorescent Lamp: Bar Code Reading* | After Irradiation by Fluorescent Lamp: PCS Value (660 nm) | After Irradiation by Fluorescent Lamp: Bar Code Reading* |
|---|---|---|---|---|
| Example I-1 | 0.82 | o | 0.75 | o |
| Example I-2 | 0.80 | o | 0.75 | o |
| Example I-3 | 0.80 | o | 0.72 | o |
| Comparative Example I | 0.75 | o | 0.31 | x |
| Example II | 0.82 | o | 0.74 | o |
| Comparative Example II | 0.76 | o | 0.33 | x |
| Example III | 0.80 | o | 0.75 | o |

*Evaluation of bar code reading:
o: Readable
x: Unreadable

As shown in the above table, in the colored portions obtained using the pressure-sensitive recording sheets of the present invention, the PCS values were minimally lowered even after irradiation by the fluorescent lamp and the bar codes still could be read even after the irradiation of the fluorescent lamp, while in the cases of the comparative examples, the PCS values after irradiation by the fluorescent lamp were greatly lowered and the bar codes could not be read after the irradiation by the fluorescent lamp.

As described hereinbefore, according to the pressure-sensitive recording sheet and sheet assembly of the present invention, colored images can be formed thereon capable of being read by an optical reading apparatus of red light having wavelengths of from 620 nm to 700 nm even after exposing the colored images to light.

While the invention has been described in detail and with reference to specific examples thereof, it will be apparent to one skilled in the art that various changes and modifications can be made therein without departing from the spirit and scope thereof.

What is claimed is:

1. A method of optically reading colored record images formed by the reaction of a substantially colorless electron donating dye and an electron accepting developer in a pressuresensitive recording sheet, comprising the step of scanning the pressure-sensitive recording sheet with a red light having a wavelength of from 620 nm to 700 nm, wherein said pressure-sensitive recording sheet comprises an electron accepting developer layer containing a metal salt of an aromatic carboxylic acid as the developer and an electron donating dye layer containing a phthalide compound represented by the following formula (I) as the electron donating dye:

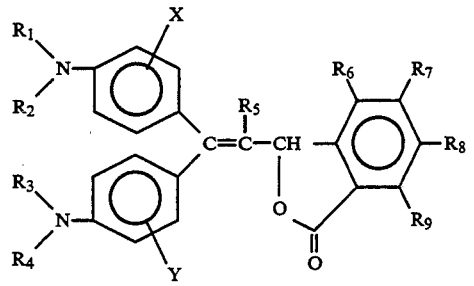

(1)

wherein $R_1$, $R_2$, $R_3$, and $R_4$ each represents a substituted or unsubstituted alkyl group, a substituted or unsubstituted aralkyl group, or a substituted or unsubstituted aryl group; said $R_1$ and $R_2$ or said $R_3$ and $R_4$ may combine with each other to form a ring; $R_5$ represents a hydrogen atom or an alkyl group; $R_6$, $R_7$, $R_8$, and $R_9$ each represents a hydrogen atom, a alogen atom, an alkyl group, an alkoxy group, a substituted amino group, or an alicyclic amino group; and X and Y each represents a hydrogen atom, an alkyl group, or an alkoxy group.

2. The method as in claim 1, wherein the electron donating dye layer further contains a fluoran derivative having an anilino group at the 2-position and a substituted amino group at the 6-position.

3. The method as in claim 2, wherein the fluoran derivative is represented by the following formula:

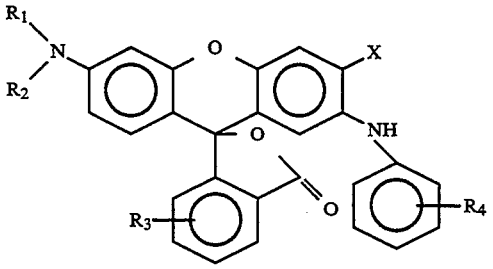

wherein $R_1$, $R_2$, and $R_3$ each represents an alkyl group having from 1 to 10 carbon atoms; $R_4$ represents a hydrogen atom or an alkyl group having from 1 to 8 carbon atoms; and X represents an alkyl group having from 1 to 8 carbon atoms or a chlorine atom.

4. The method as in claim 1, wherein the colorless electron donating dye layer is formed on one surface of a base paper and the electron acceptive developer layer is formed on the opposite surface of the base paper.

5. The method as in claim 1, wherein the electron accepting developer layer contains the metal salt of an aromatic carboxylic acid in an amount of from 0.1 $g/m^2$ to 3.0 $g/m^2$ and the electron donating dye layer contains the phthalide compound in an amount of from 0.02 $g/m^2$ to 0.10 $g/m^2$.

6. A method as in claim 1, wherein the metal salt of an aromatic carboxylic acid comprises a metal salt of a salicylic acid.

7. The method as in claim 1, wherein the electron acceptive developer is microencapsulated.

* * * * *